US010563955B2

(12) United States Patent
Pniel et al.

(10) Patent No.: US 10,563,955 B2
(45) Date of Patent: Feb. 18, 2020

(54) SMALL FIRE-ARM SIGHT MOUNT

(71) Applicant: MEPROLIGHT (1990) LTD., Or-Akiva (IL)

(72) Inventors: Zeev Pniel, Petah Tiqva (IL); Yakov Dekhtyar, Tel Aviv (IL)

(73) Assignee: MEPROLIGHT (1990) LTD., Or-Akiva (IL)

( * ) Notice: Subject to any disclaimer, the term of this patent is extended or adjusted under 35 U.S.C. 154(b) by 0 days.

(21) Appl. No.: 15/849,684

(22) Filed: Dec. 21, 2017

(65) Prior Publication Data

US 2018/0202770 A1 Jul. 19, 2018

(30) Foreign Application Priority Data

Jan. 17, 2017 (IL) ..... 250152

(51) Int. Cl.
*F41G 11/00* (2006.01)

(52) U.S. Cl.
CPC ..... *F41G 11/003* (2013.01)

(58) Field of Classification Search
CPC . F41G 11/003; F41G 1/10; F41G 1/16; F41G 1/387
USPC ..... 42/127
See application file for complete search history.

(56) References Cited

U.S. PATENT DOCUMENTS 308,699 A * 12/1884 Rabbeth ..... F41G 1/17 42/140
1,198,295 A * 9/1916 Ward et al. ..... F41G 1/28 42/136
4,567,683 A 2/1986 Buehler
5,063,677 A * 11/1991 Millett ..... F41G 1/26 42/137
5,522,167 A 6/1996 Teetzel
5,560,703 A 10/1996 Capps, III
7,145,703 B2 * 12/2006 Sieczka ..... F41G 1/30 359/15
7,204,052 B2 4/2007 Swan
7,526,890 B1 * 5/2009 Keng ..... F41G 1/18 42/111
8,082,688 B2 * 12/2011 Elpedes ..... F41G 1/14 42/131
8,393,105 B1 * 3/2013 Thummel ..... F41G 11/004 42/127
8,448,374 B2 * 5/2013 Samson ..... F41G 1/18 42/125
8,484,882 B2 * 7/2013 Haley ..... F41G 1/02 42/111

(Continued)

*Primary Examiner* — Michelle Clement
(74) *Attorney, Agent, or Firm* — Soroker Agmon Nordman

(57) ABSTRACT

A weapon sight interface for mounting a device on a weapon having a rear sight and front sight, including an enhanced rear sight for replacing the rear sight of the weapon, having a base for installing in a dovetail slot of the weapon, an elongated tail that extends along the barrel of the weapon; and one or more tritium dots or white dots configured to enable use of the enhanced rear sight as a rear sight of the weapon; and also having a quick release interface for attaching to the device and locking onto the enhanced rear sight, having guides to securely fit onto the enhanced rear sight, a quick release lever, which in a lint position causes the guides to lock onto the enhanced rear sight and in a second position releases the enhanced rear sight so that the quick release interface can slide off.

8 Claims, 5 Drawing Sheets

(56) References Cited

U.S. PATENT DOCUMENTS

| | | | | |
|---|---|---|---|---|
| 9,038,306 | B2 | 5/2015 | Trapp | |
| 9,267,759 | B2 | 2/2016 | Speroni | |
| 9,423,212 | B2 * | 8/2016 | Campean | F41G 1/18 |
| 9,752,853 | B2 * | 9/2017 | Teetzel | F41G 1/35 |
| 10,024,628 | B2 * | 7/2018 | Toner | F41G 1/16 |
| 2007/0234625 | A1 * | 10/2007 | Kidd | F41G 1/02 42/111 |
| 2008/0092424 | A1 * | 4/2008 | Keng | F41G 1/18 42/137 |
| 2008/0178511 | A1 * | 7/2008 | Storch | F41C 27/00 42/90 |
| 2012/0167438 | A1 * | 7/2012 | Daniel | F41G 11/004 42/90 |
| 2013/0185979 | A1 | 7/2013 | Fridley | |
| 2013/0219767 | A1 * | 8/2013 | Peterson | F41G 11/003 42/113 |
| 2014/0305022 | A1 * | 10/2014 | Chung | F41G 1/16 42/113 |
| 2016/0102943 | A1 * | 4/2016 | Teetzel | F41G 1/35 42/113 |

* cited by examiner

SMALL FIRE-ARM SIGHT MOUNT

TECHNICAL FIELD

The present disclosure relates generally to a universal mount for attaching peripheral devices to a small fire-arm.

BACKGROUND

Many manufactures provide enhanced peripheral devices for mounting on small fire-arms such as pistols. The enhanced peripheral devices ma include reflex sights, telescopic sights, electro-optical sights, night vision sights, cameras, laser pointers, flash lights (illuminators) and other devices. Typically special tools and actions are required to remove the simple rear sight of the fire arm and mourn the enhanced peripheral device instead, for example machining (drilling thread holes) on the top of the small fire-arm. The tools may include a drill, a hammer and punch and/or a universal sight pushing/installation tool (e.g. U.S.I.T by Meprolight LTD), which is designed to enable removal of the simple rear sight from the dovetail slot and forcefully insert the enhanced sight onto the firearm. Some sights/devices might require use of a larger tool since they are too big to be installed by the universal sight installation tool. Additionally, the sights/devices must be installed carefully to prevent damaging the sight by the use of excessive force on the sight/device.

Sight installation is not an instantaneous snap in place process but rather needs to be performed with the correct tools slowly with due care. In many cases it must be performed in a workshop by a qualified gunsmith since the original sight might be stuck or corroded and the new sight might be susceptible to damage front a strong impact. Accordingly, a user cannot quickly exchange peripheral devices, for example install a reflex sight for day use and then quickly swap to a night vision sight for night use. Likewise it is complicated to quickly exchange sights for demonstration purposes, rather it is simpler to demonstrate with multiple fire-arms each with a different sight installed. Likewise, if an installed device malfunctions the fire arm may be unusable until it is taken back to the workshop and the faulty device is removed and replaced with the original sight or with a functional replacement sight.

SUMMARY

An aspect of an embodiment of the disclosure relates to an enhanced weapon mount for a small fire-arm including an enhanced rear sight and a quick release interface. The enhanced rear sight serves as a replacement for the standard rear sight of the small fire-arm and is designed to enable locking the quick release interface onto it so that a device coupled to the interface can withstand weapon recoil forces. The quick release interface can be locked onto the enhanced rear sight and can be quickly released. The quick release interface is coupled to a device on one side (e.g. on the top of the interface) and attaches to the enhanced rear sight on another side (e.g. on the bottom side). Optionally, multiple quick release interfaces may be provided with the enhanced rear sight so that each can be coupled to a different device and during use of the fire-arm be exchanged rapidly.

The enhanced rear sight alone or with a replacement from sight can serve as a weapon sight, for example as a tritium two or three dot sight or a white dot two or three dot sight. When an advanced device is installed, the enhanced rear sight can be ignored.

In an exemplary embodiment of the disclosure, the enhanced rear sight is attached into the rear dovetail slot of the fire-arm. The enhanced rear sight includes an elongated tail extending along the barrel of the fire-arm toward the front sight. The quick release interface is designed to lock onto the enhanced rear sight. Optionally, the quick release interface is locked and released by rotating a lever. In an exemplary embodiment of the disclosure, the quick release interface includes guides that close on to the elongated tail. Optionally, the quick release interface also includes a crossbar that fits into a crevice on the enhanced rear sight to prevent the quick release interface from sliding.

There is thus provided according to an exemplary can of the disclosure a weapon sight interface for mounting a device on a weapon having a rear sight and front sight, comprising:

an enhanced rear sight for replacing the rear sight of the weapon, comprising:

1. a base for installing in a dovetail slot of the weapon;
2. an elongated tail that extends along the barrel of the weapon toward the front sight for locking an interface onto the enhanced rear sight; and
3. one or more tritium dots or white dots configured to enable use of the enhanced rear sight as a rear sight of the weapon;

a quick release interface for attaching to the device and locking onto the enhanced rear sight, comprising:

1. guides to securely fit onto the enhanced rear sight;
2. a quick release lever, which in a first position causes the guides to lock onto the enhanced rear sight and in a second position releases the enhanced rear sight so that the quick release interface can slide off of the enhanced rear sight.

In an exemplary embodiment of the disclosure, the front sight of the weapon is replaced with a front sight having a tritium dot or white dot to match the enhanced rear sight. Optionally, the enhanced rear sight includes two tritium or white dots on two sides of a U shaped, V shaped or square shaped crevice. In an exemplary embodiment of the disclosure, the enhanced rear sight is tightened onto the barrel of the weapon by a screw in the crevice between the dots. Optionally, the enhanced rear sight includes a crevice on the elongated tail extending across the width of the elongated tail for accommodating a crossbar to securely position the quick release interface on the enhanced rear sight. In an exemplary embodiment of the disclosure, the quick release interface includes a moveable guide and a non-moveable guide. Optionally, the quick release lever in the first position presses on the moveable guide to lock the quick release interface onto the enhanced rear sight. In an exemplary embodiment of the disclosure, the quick release interface includes a crossbar bolt that fits into a matching crevice on the enhanced rear sight to stabilize the quick release interface relative to the enhanced rear sight. Optionally, the quick release interface includes multiple screw holes for coupling the quick release interface to the device. In an exemplary embodiment of the disclosure, the quick release lever of the quick release interface is attached to one side of a crossbar that extends through the guides, across the width of the quick release interface and the crossbar is held in place on another side by a nut that is threaded onto the crossbar.

There is further provided according to an exemplary embodiment of the disclosure, a method of interfacing a device to a weapon having a barrel with a rear sight and front sight thereon, comprising:

removing the rear sight from a dovetail slot on the weapon;

installing an enhanced rear sight into the dovetail slot of the weapon, the enhanced rear site having an elongated tail that extends along the barrel of the weapon toward the front site;

coupling the device to a quick release interface;

placing the quick release interface with the device onto the elongated tail of the enhanced rear sight;

immobily locking the quick release interface to the enhanced rear sight with a lever that is configured to toggle between an opened state and a locked state so that they move together under recoil forces;

wherein the enhanced rear sight can serve as an independent gun-sight.

In an exemplary embodiment of the disclosure, the independent gun sight uses tritium dots. Optionally, the independent gun sight uses white dots. In an exemplary embodiment of the disclosure, the independent gun sight includes two dots on two sides of as U shaped, V shaped or square shaped crevice for enabling aiming, of the device. In an exemplary embodiment of the disclosure, the enhanced rear sight includes a crevice on the elongated tail extending across the width of the elongated tail for accommodating a crossbar to securely position the quick release interface on the enhanced rear sight. Optionally, the quick release interface includes, a moveable guide and a non-moveable guide for immobily locking the quick release interface to the enhanced rear sight. In an exemplary embodiment of the disclosure, the lever in a first position presses on the moveable guide to lock the quick release interface onto the enhanced rear sight. Optionally, the quick release interface includes a crossbar bolt that fits into a matching crevice an the enhanced rear sight to stabilize the quick release interface relative to the enhanced rear sight, in an exemplary embodiment of the disclosure, the quick release interface includes multiple screw holes for coupling the quick release interface to the device. Optionally, the method further comprises replacing the front sight with an enhanced front sight having a white dot or a tritium dot.

BRIEF DESCRIPTION OF THE DRAWINGS

The present disclosure will be understood and better appreciated from the following detailed description taken in conjunction with the drawings. Identical structures, elements or parts, which appear in more than one figure, are generally labeled with the same or similar number in all the figures in which they appear, wherein.

DETAILED DESCRIPTION

Figure 1:
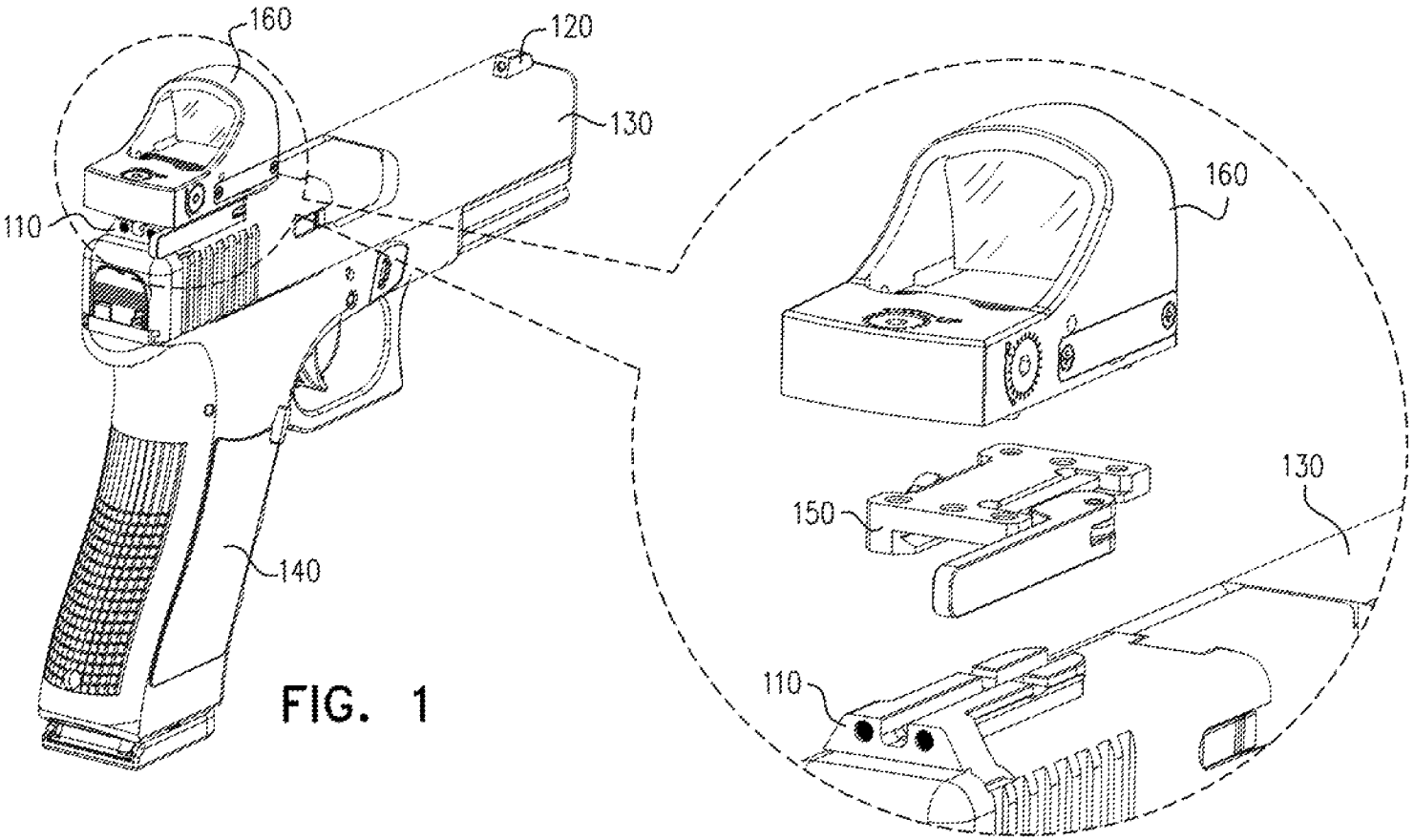
FIG. 1 is a schematic illustration of an exploded view of a weapon with an enhanced rear sight, a quick release interface and a reflex sight, according to an exemplary embodiment of the disclosure.

FIG. 1 is a schematic illustration of an exploded view of a weapon 140 with an enhanced rear sight 110, a quick release interface 150 and a reflex sight 160, according to an exemplary embodiment of the disclosure. In an exemplary embodiment of the disclosure, the simple rear sight (in the dovetail slot) of a small fire-arm weapon 140 (e.g. a pistol) is replaced with an enhanced rear sight 110.

Figure 2A:
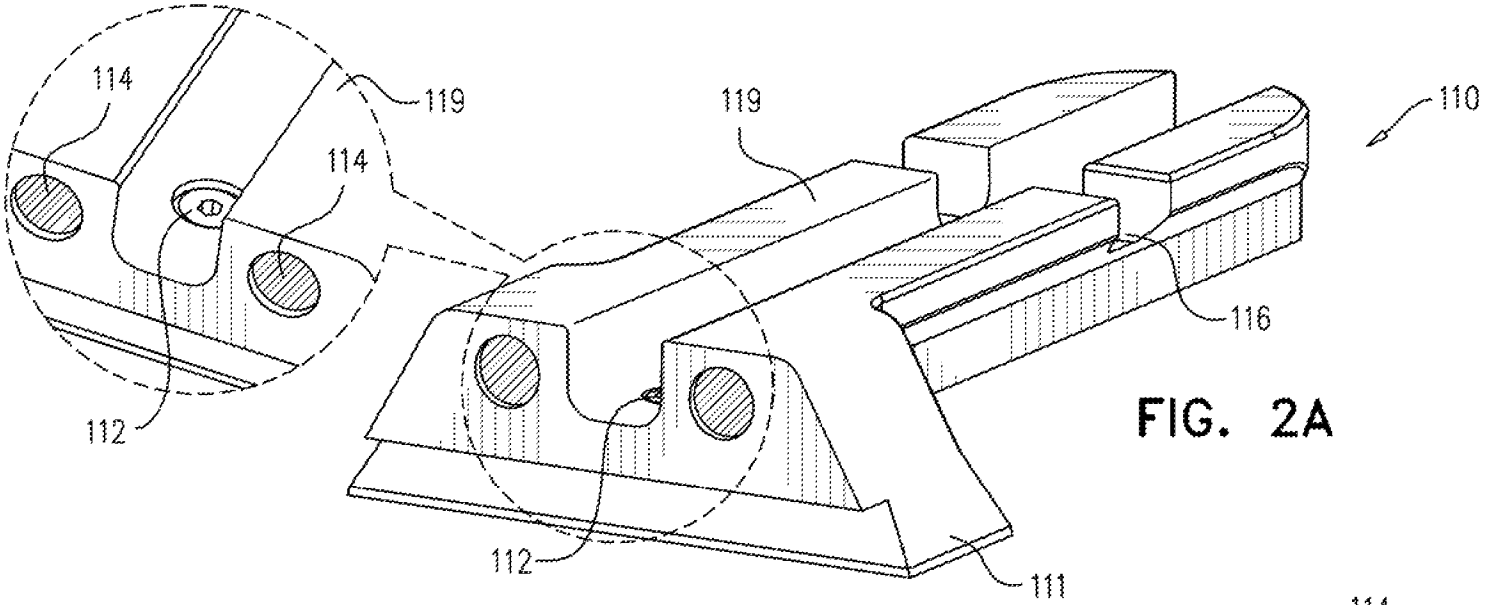
FIGS. 2A and 2B are schematic illustrations of a perspective top view and perspective bottom view of an enhanced rear sight, according to an exemplary embodiment of the disclosure.
Figure 2B:
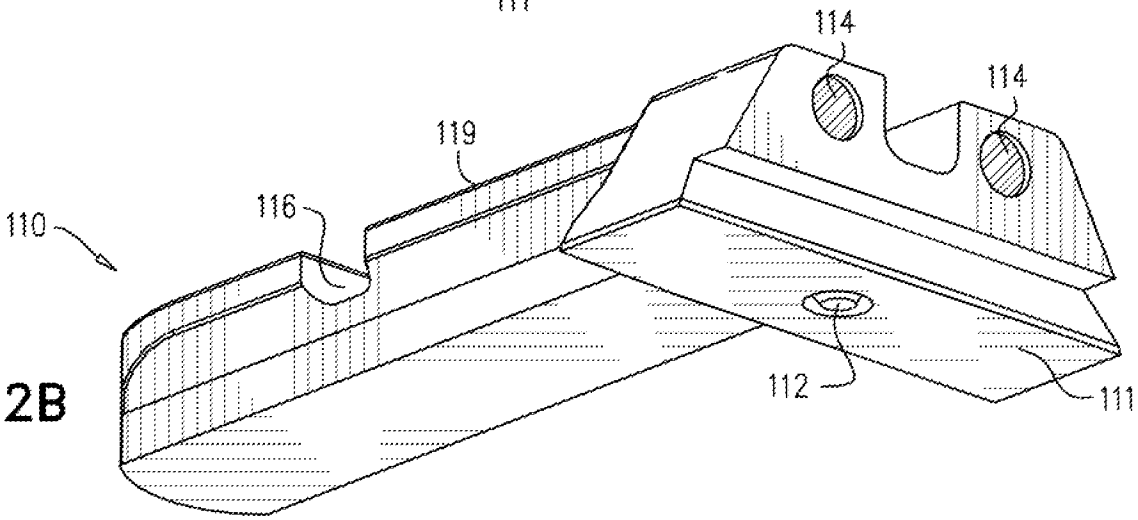

FIGS. 2A and 2B are a schematic illustrations of a perspective top view and perspective bottom view of the enhanced rear sight 110, according to an exemplary embodiment of the disclosure. The enhanced rear sight 110 includes a base 111 that fits into the dovetail slot of weapon 140 and an elongated tail 119 that extends along the top of barrel 130 of weapon 140 to serve as a base for coupling larger sights. In an exemplary embodiment of the disclosure, enhanced rear site 110 may be U shaped, V shaped or square shaped with two tritium illuminating dots 114, one on each side to serve as a tritium night sight when no further elements are attached to the enhanced rear sight 110. Optionally, the front sight 120 of the weapon 140 is also replaced with a tritium dot so that the enhanced rear sight 110 with front sight 120 serve as a complete tritium night sight system (e.g. by aligning the front tritium dot to be viewed through the U shaped void between the two tritium dots 114). Alternatively, the enhanced rear sight 10 with front sight 120 serve as a three dot sight system (e.g. having three white dots or other colored dots).

In some embodiments of the disclosure, enhanced rear sight 110 includes a tightening screw 112, for example between the dots 114 to tighten the base 111 of enhanced rear sight 110 when installed in the dovetail slot of weapon 140.

In an exemplary embodiment of the disclosure, elongated tail 119 includes a crevice 116 (e.g. a U shaped or semicircular crevice) across the width of the elongated tail 119. The crevice 116 serves to accommodate or grasp an interface that is coupled to an advanced sight e.g. reflex sight 160.

Figure 3A:
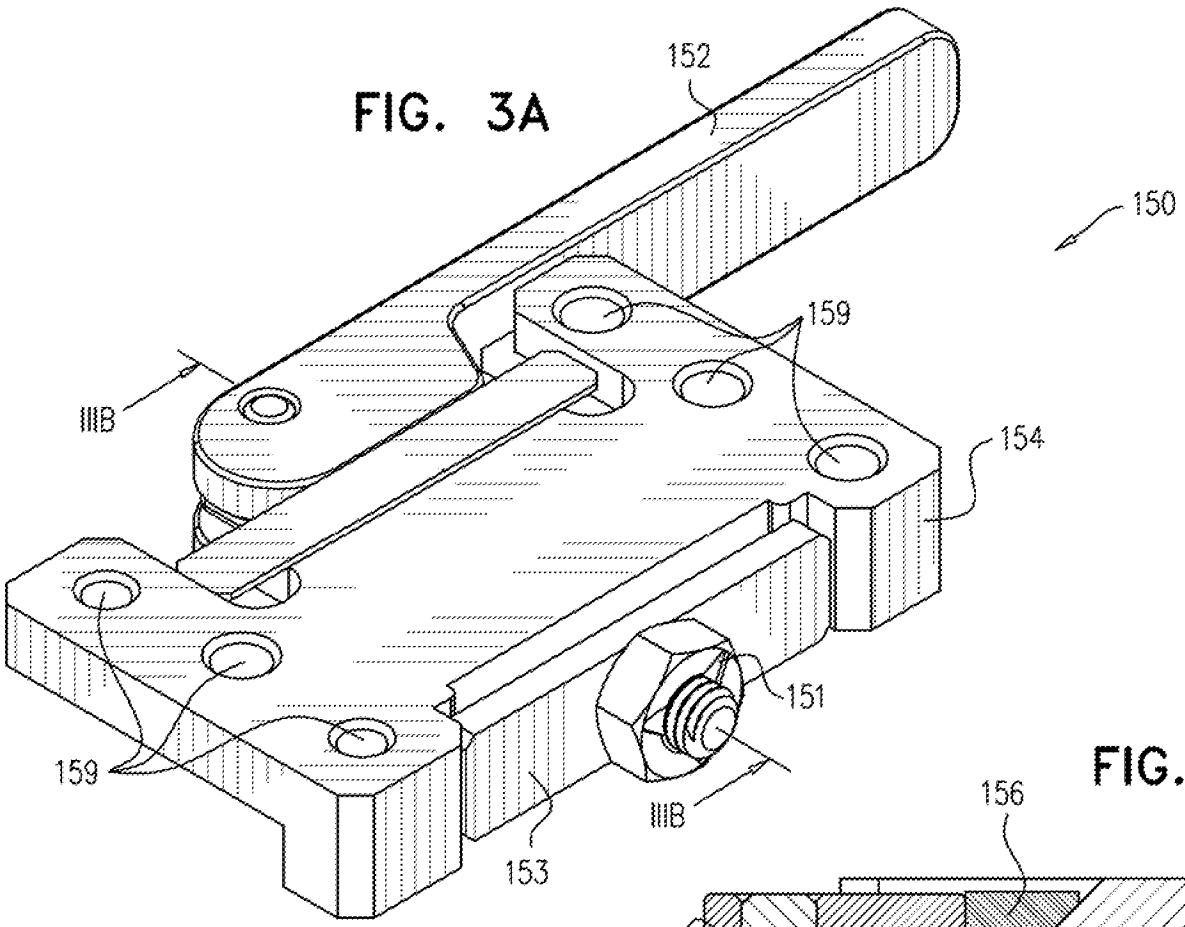
FIGS. 3A and 3B are schematic illustrations of a perspective top view and cross sectional view of a quick release interface for attaching to an enhanced rear sight, according to an exemplary embodiment of the disclosure.
Figure 3B:
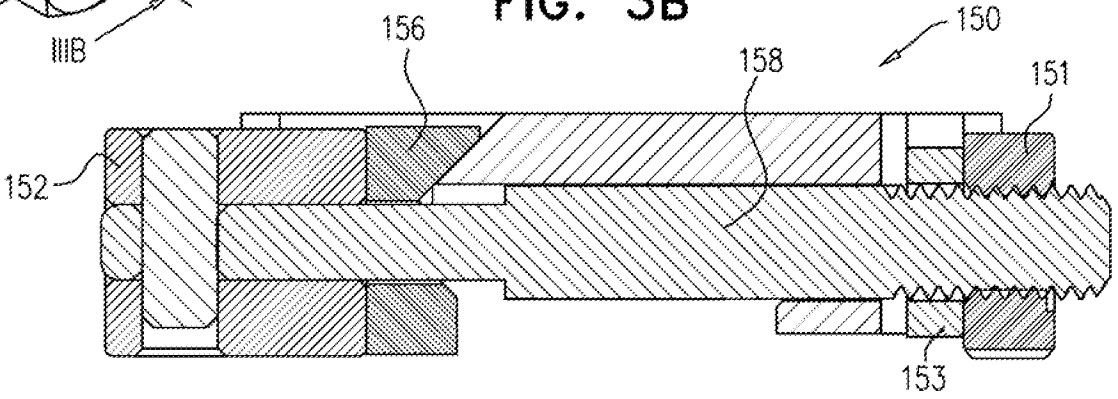
Figure 4:
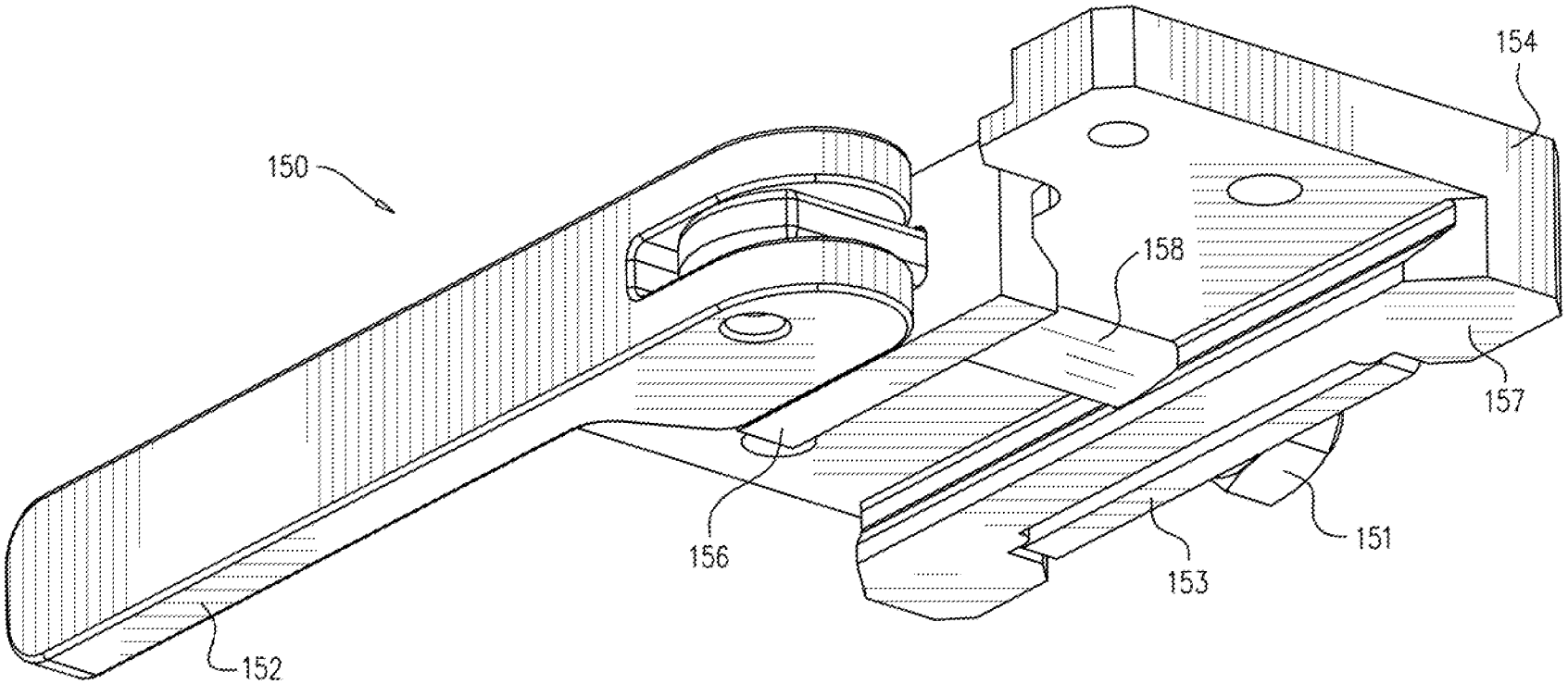
FIG. 4 is a schematic illustration of a perspective bottom view of a quick release interface for attaching to an enhanced rear sight, according to an exemplary embodiment of the disclosure.

FIGS. 3A and 3B are schematic illustrations of a perspective top view and a cross sectional view of quick release interface 150 for attaching to enhanced rear sight 110, and FIG. 4 is a schematic illustration of a perspective bottom view of quick release interface 150 for attaching to enhanced rear sight 110, according to an exemplary embodiment of the disclosure. In an exemplary embodiment of the disclosure, quick release interface 150 is designed with a body 154 to fit onto enhanced rear sight 110 and to be quickly locked onto enhanced rear sight 110. Optionally, quick release interface 150 includes a non-moveable guide 157 and a moveable guide 156 to securely fit onto elongated tail 119 of enhanced rear sight 110. Quick release interface 150 may further include a crossbar bolt 158 that connects between the moveable guide 156 and a leaf spring 153 through the non-moveable guide 157. Optionally, one side of the crossbar bolt 158 is locked with a nut 151 via leaf spring 153 and on the other side the crossbar bolt 158 is held by a quick release eccentric lever 152 that is used to clamp the moveable guide 156 against body 154 to hold elongated tail 119 tightly when the lever is locked. When the lever is released the moveable guide 156 release the elongated tail 119 so that quick release interface 150 can be removed from enhanced rear sight 110. Quick release lever 152 enables locking and releasing quick release interface 150 at the flip of a lever. Optionally, crossbar bolt 158 is designed to fit into crevice 116 to stabilize quick release interface 150 on enhanced rear sight 110 and prevent quick release interface 150 from moving forward or backward, for example due to recoil forces. In some embodiments of the disclosure, moveable guide 156 is non-moveable and leaf spring 153 enables the lever 152 to toggle between an open state and a locked state. Alternatively, moveable guide 156 with leaf spring 153 enable the lever 152 to toggle.

Figure 5:
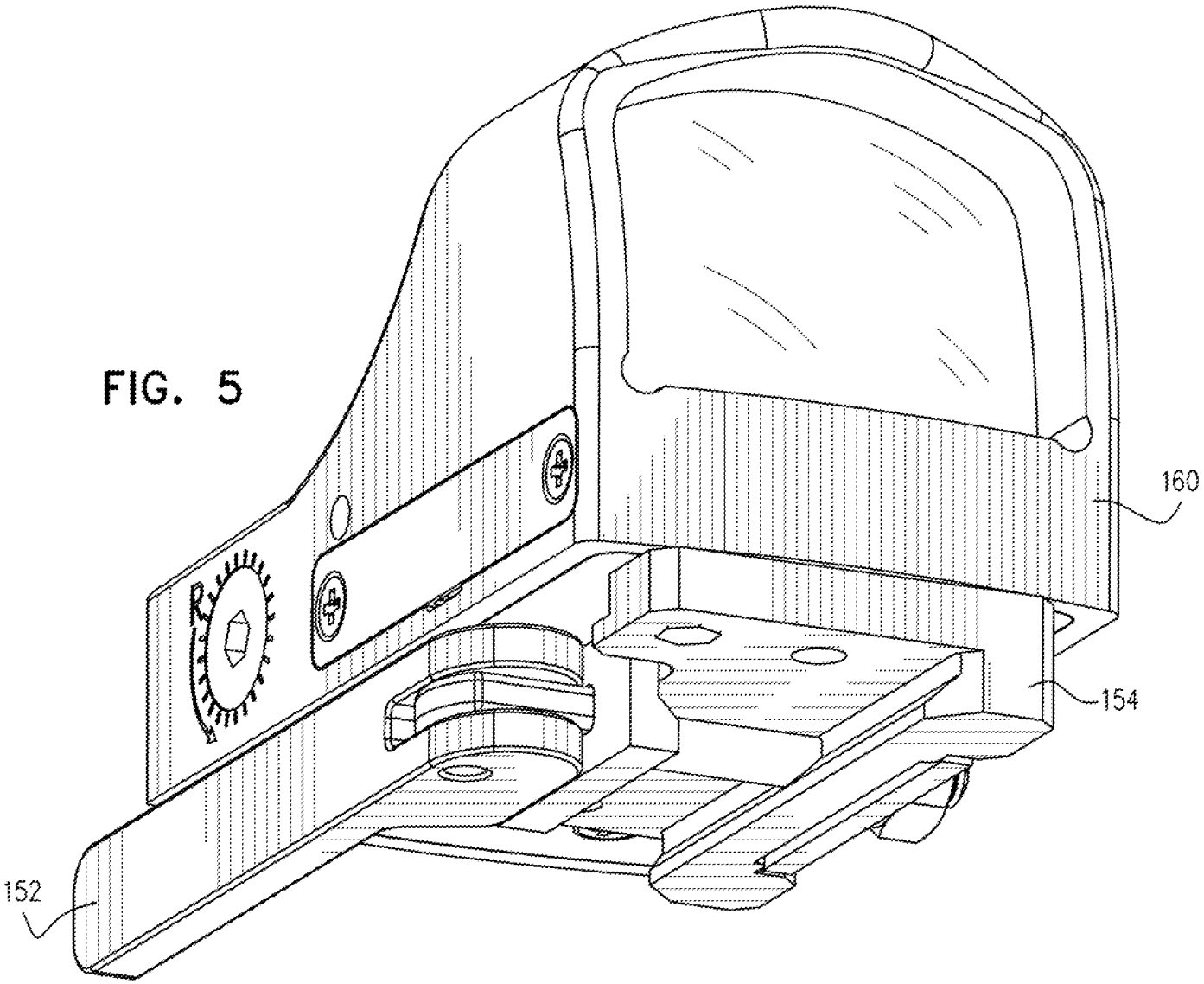
FIG. 5 is a schematic illustration of a perspective view of a reflex sight attached to a quick release mechanism, according to an exemplary embodiment of the disclosure.

FIG. 5 is a schematic illustration of a perspective view of reflex sight 160 attached to a quick release mechanism 150, according to an exemplary embodiment of the disclosure. In an exemplary embodiment of the disclosure, body 154 of quick release interface 150 include attachment holes 159 through which screws, nails or other locking elements may be inserted to couple quick release interface to a reflex sight 160 or any other device, for example reflex sights, telescopic sights, electro-optical sights, night vision sights, cameras, laser pointers, flash lights (illuminators) and other devices. Optionally, a user can install a single enhanced rear sight 110 and have multiple quick release interfaces 150 pre-installed with various devices (e.g., reflex sight 160). Within seconds the user can release lever 152 remove one device with its quick release interface 150 and replace it with another.

Likewise it should be noted that enhanced rear sight 110 with front sight 120 provide a basic three dot tritium sight or three dot white dot sight. Accordingly, if reflex sight 160 or whatever device mounted on the enhanced rear sight 110 is damaged or malfunctions, it can be removed and rapidly replaced with another device or the user can continue using weapon 140 with the basic tritium sight.

In some embodiments of the disclosure, body 154 may be designed when deployed on enhanced rear sight 110 to be blocked by dots 114 on enhanced rear sight 110 so that quick release interface 150 cannot slide further backward due to weapon recoil. The blocking by dots 114 can be in addition or instead of the blocking by crossbar bolt 158 in crevice 116.

It should be appreciated that the above described methods and apparatus may be varied in many ways, including omitting or adding steps, changing the order of steps and the type of devices used. It should be appreciated that different features may be combined in different ways. In particular, not all the features shown above in a particular embodiment are necessary in every embodiment of the disclosure. Further combinations of the above features are also considered to be within the scope of some embodiments of the disclosure. It will also be appreciated by persons skilled in the art that the present disclosure is not limited to what has been particularly shown and described hereinabove.

We claim:

1. A weapon sight interface for mounting a device on a weapon having a rear sight and front sight, comprising:

an enhanced rear sight configured to replace the rear sight of the weapon, comprising:

1. a base configured for installing in a dovetail slot of the weapon;
2. an elongated tail that is configured to extend from base along a body of the weapon toward the front sight for locking an interface onto the enhanced rear sight; wherein the elongated tail includes a single U shaped or semicircular crevice across a width of the elongated tail; and
3. one or more tritium dots or white dots on the base configured to enable use of the enhanced rear sight as a rear sight of the weapon;

a quick release interface configured to be attachable to the device and configured to be lockable onto the elongated tail of the enhanced rear sight, comprising:

1. guides to securely fit onto the elongated tail of the enhanced rear sight;
2. a quick release lever, which in a first position causes the guides to lock onto the elongated tail and in a second position releases the elongated tail so that the quick release interface can slide off of the elongated tail; and
3. a crossbar bolt that is configured to fit into the single crevice to stabilize the quick release interface and prevent the quick release interface from moving relative to the elongated tail; and wherein the base is wider than the elongated tail and configured to block the quick release interface from sliding backward off the elongated tail.

2. The weapon sight interlace according to claim 1, wherein a front sight having a tritium dot or white dot to match the enhanced rear sight is provided with the interface to enable replacing the front sight of the weapon.

3. The weapon sight interface according to claim 1, wherein the enhanced rear sight includes two tritium, or white dots on two sides of a U shaped, V shaped or square shaped crevice.

4. The weapon sight interface according to claim 3, wherein the enhanced rear sight is configured to be tightened onto the body of the weapon by a screw in the crevice between the dots.

5. The weapon sight interface according to claim 1, wherein the quick release interface includes a moveable guide and a non-moveable guide.

6. The weapon sight interface according to claim 5, wherein the quick release lever in the first position presses on the moveable guide to lock the quick release interface onto the enhanced rear sight.

7. The weapon sight interface according to claim 1, wherein the quick release interface includes multiple screw holes configured to couple the quick release interface under the device.

8. The weapon sight interface according to claim 1, wherein the quick release lever of the quick release interface is attached to one side of a crossbar that extends through the guides, across the width of the quick release interface and the crossbar is held in place on another side by a nut that is threaded onto the crossbar.

* * * * *